United States Patent [19]

Brown

[11] Patent Number: 4,923,078

[45] Date of Patent: May 8, 1990

[54] BONNET FOR BEVERAGE DISPENSING APPARATUS

[75] Inventor: Samuel E. Brown, San Antonio, Tex.

[73] Assignee: Lancer Corporation, San Antonio, Tex.

[21] Appl. No.: 165,834

[22] Filed: Mar. 9, 1988

[51] Int. Cl.[5] ..... B65D 6/28

[52] U.S. Cl. ..... 220/4 R; 206/459

[58] Field of Search ..... 206/459; 220/4 R, 4 F

[56] References Cited

U.S. PATENT DOCUMENTS

| | | | |
|---|---|---|---|
| 1,887,956 | 11/1952 | Rypinski | 220/4 R |
| 2,115,720 | 5/1938 | Holmes | 220/4 F |
| 2,741,390 | 4/1956 | Moore | 220/4 R |
| 3,279,838 | 10/1966 | Hamilton | 220/4 F |
| 3,587,907 | 6/1971 | Okuda et al. | 220/4 R |
| 4,099,648 | 7/1978 | Kirkton | 220/4 R |

FOREIGN PATENT DOCUMENTS

| | | | |
|---|---|---|---|
| 0795873 | 6/1958 | United Kingdom | 220/4 |
| 0815337 | 6/1959 | United Kingdom | 220/4 F |

*Primary Examiner*—Jimmy G. Foster

[57] ABSTRACT

A bonnet for covering the top of a beverage dispensing apparatus, particularly a carbonated beverage dispensing apparatus. The bonnet is formed in the shape of a substantially rectangular enclosure and assembled from first and second members, the first member being formed into the side walls and one end of the bonnet and the second member being formed to comprise the top edges of the sides and end of the bonnet as well as the top thereof. In this manner, the first member can be painted one solid color and the second member can be painted a second color such that the second color of the second member becomes the top border of the side wall of the bonnet, thereby simplifying the application of the trademark and graphics, as well as the assembly, of the bonnet.

5 Claims, 2 Drawing Sheets

BONNET FOR BEVERAGE DISPENSING APPARATUS

BACKGROUND OF THE INVENTION

The present invention relates to a bonnet for covering the top of a beverage dispensing apparatus. More particularly, the present invention relates to a bonnet for covering the top of an apparatus for dispensing carbonated beverages on which the trademark(s) of the beverages dispensed therefrom are displayed to the consumer or purchaser of the beverage.

Such bonnets are presently in use, and a typically available bonnet is shown in FIG. 1 of the drawings. That bonnet 10 is a substantially rectangular enclosure comprised of side walls 12, ends 14, and top 16, the top 16 being provided with a plurality of holes 18 for ventilation of the dispensing apparatus (not shown) covered by bonnet 10. In terms of simply covering and, therefore, protecting a dispensing apparatus, bonnet 10 is quite adequate. But the function of such a bonnet is as much aesthetic, i.e., as a "billboard" for display of the trademarks of the beverages dispensed therefrom as for protection, and in that respect, the bonnet 10 shown in FIG. 1 is characterized by a number of disadvantages and limitations.

For instance, the producers of the beverages, who are the proprietors of the trademarks displayed on the side walls of the bonnet, are exacting in, among other things, the requirements as to the location of the colors of the various parts of the marks and/or logo, the sizes of the letters and design, and the width or existence of any border(s) which must be maintained around the mark or logo (collectively referred to herein as the trademark "graphics"). Referring, for example, to FIG. 1, an arbitrary "logo" 20 is shown applied to one of the side walls 12 thereof. The side walls 12 and ends 14 are usually painted with a light, background color and logo 20 is commonly applied by application of a decal or by silk screen painting over that light background. Either method results in a border 22 around the logo. As an example, in the case of a bonnet used to cover an apparatus used for dispensing products of the Coca-Cola Company, the familiar "COKE" trademark graphics appear on a red field that is applied to a white background.

Certain other trademark proprietors specify that no border be maintained around the logo or around one or more sides of the logo, and it is common for these proprietors who do specify that a border be maintained around the logo or around one or more sides of the logo to occasionally change that specification to delete or alter the border. It is in this event that difficulties are encountered in applying the logo to the side walls of the bonnet, especially if the borders at the corners 24 of bonnet 10 in FIG. 1 are deleted altogether.

The use of a decal to apply the logo 20 is, for practical purposes, impossible when the border 22 at the corners 24 of bonnet 10 is eliminated. That result stems from the practicalities of applying the decal to the side wall 12 and end 14. In addition to the usual difficulty in applying the decal, i.e., removing all air bubbles and applying the decal to the proper location so that a border which meets specification is maintained, both of which are labor intensive and, therefore, expensive, it is extremely difficult to apply a decal around corners such as the corners 24. Almost invariably, air bubbles remain under the decal and the edge of the decal does not end exactly at the corner 24 of the other end of the side wall 12 of bonnet 10. Even if borders 22 are specified at either the top or bottom of side wall 12, it is difficult to maintain the borders 22 at the dimension required by the specifications when a decal is applied around a corner.

In addition to the difficulty of applying the trademark and graphics, the construction of bonnet 10 is relatively complicated. Top 16 must, of course, be assembled to side walls 12 and ends 14, which are constructed of one piece, but doing so leaves unfinished edges at the top of side walls 12. It is, therefore, necessary to finish those edges, which in the currently available bonnet shown in FIG. 1 is accomplished by applying double-sided tape (not shown in FIG. 1) to either the top edges of side walls 12 and ends 14 or the bottom of vinyl strips 26 and then applying the vinyl strips 26 to the top edges of side walls 12 and ends 14. Finishing bonnet 10 in this manner requires additional assembly steps, thereby increasing the cost.

There is, therefore, a need for a bonnet for a beverage dispensing apparatus to which the trademark and graphics to be displayed thereon can be more easily applied and which is less labor-intensive and expensive to build. Consequently, it is an object of the present invention to provide such a bonnet.

It is another object of the present invention to provide a bonnet for a beverage dispensing apparatus which presents an aesthetically pleasing appearance when the trademark(s) and graphics are applied thereto.

Another object of the present invention is to provide a bonnet for a beverage dispensing apparatus in which the trademark(s) and graphics to be applied thereto are integrated with the construction of the bonnet.

Another object of the present invention is to provide a bonnet for a beverage dispensing apparatus comprised of two pieces which can be painted different colors such that each piece forms part of the trademark(s) and graphics applied thereto.

Other objects, and the advantages of the present invention, will be apparent to those skilled in the art from the following detailed description of a presently preferred embodiment of the invention.

SUMMARY OF THE INVENTION

These objects are accomplished by providing a bonnet for a beverage dispensing apparatus comprising a first member having a front and integral sides for forming the bottom portion of three walls of a substantially rectangular enclosure and a second member for covering the top of the enclosure. One end and the sides of the first member are provided with a smooth external surface for receiving paint thereon, and the second member is provided with integral, down-turned edges on three sides thereof for engaging the top edges of the end and sides of the first member to form three walls of the enclosure. Each of the down-turned edges of the second member is provided with a smooth external surface for receiving paint thereon, and means is provided for securing the down-turned edges of the second member to the top edges of the end and sides of the first member for forming a substantially flat external surface on each of the three walls of the enclosure. Means is also provided for closing the fourth wall of the enclosure.

DETAILED DESCRIPTION OF THE PREFERRED EMBODIMENT

Figure 2:
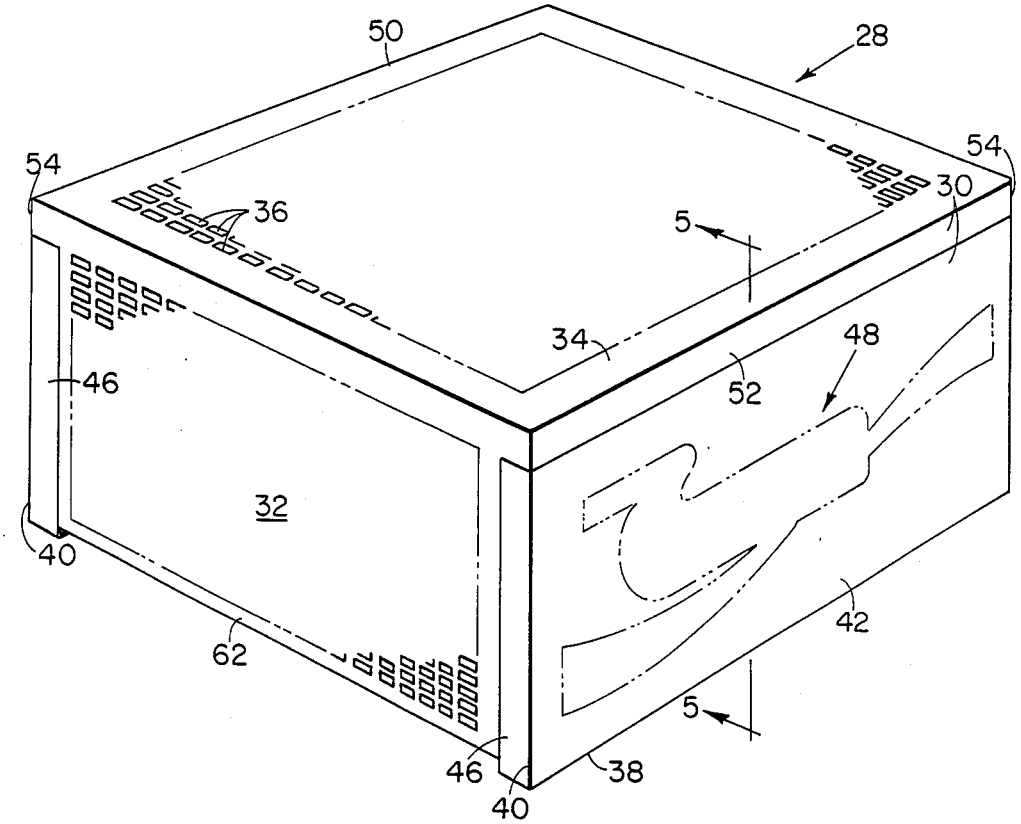
FIG. 2 is a perspective view of a bonnet constructed in accordance with the teachings of the present invention.

Referring to FIG. 2, there is shown a bonnet 28 constructed in accordance with the teachings of the present invention. Bonnet 28 is a substantially rectangular enclosure and is provided with side walls 30 and front and back ends 32. Bonnet 28 is provided with a top 34 having a plurality of holes 36 therein for ventilating the beverage dispensing apparatus (not shown) which bonnet 28 covers.

Figure 5:
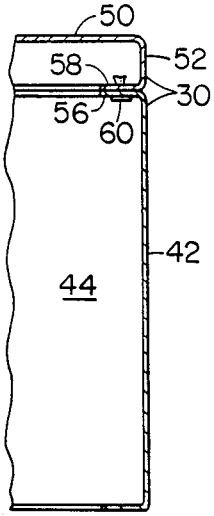
FIG. 5 is a partial sectional view taken along the lines 5—5 in FIG. 2.

Bonnet 28 is preferably formed from two pieces of metal or other material by placing appropriate bends in a first member 38 to form the corners 40 of the sides 42 and one end 44 (see FIG. 5) of the rectangular enclosure of bonnet 28. First member 38 is provided with only a partial second end 46, leaving an opening (not numbered) in that second end of bonnet 28 for a purpose which will be described. Each of the sides 42 and end 44 is provided with a smooth external surface for receiving paint thereon.

Bonnet 28 is also comprised of a second member 50 which covers the top of the rectangular enclosure. The second member 50 is provided with down-turned edges 52 on three sides thereof and, like the first member 38, is preferably constructed of one piece of metal or other material which is bent to form the corners 54, each of the down-turned edges 52 having a smooth external surface for receiving paint thereon. Both the first member 38 and second member 50 are provided with means for securing the down-turned edges 52 to the top edges of the sides 42 and end 44 of first member 38 in the form of the flanges 56 at the top edge of the sides 42 and end 44 of first member 38, the flange 58 formed along the down-turned edges 52 of second member 50, and the rivets 60 secured through the respective flanges 56 and 58.

Figure 4:
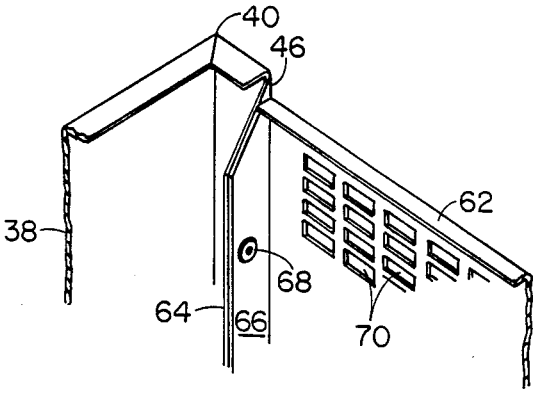
FIG. 4 is a perspective, partially cut away view of the bottom of one of the corners of the bonnet of FIG. 2.

Bonnet 28 is also provided with means for closing the fourth side of the rectangular enclosure in the form of an end 62 integral with second member 50. The partial end walls 56 of the second end of first member 38 and the edges of end 62 of second member 50 are provided with mating flanges 64 and 66, respectively (see FIG. 4), for receiving rivets 68 therethrough to secure end 62 in place between the partial end walls 46 of first member 38. Vent holes 70 are provided in end 62 for ventilation of the dispensing apparatus (not shown) enclosed within bonnet 28.

Figure 1:
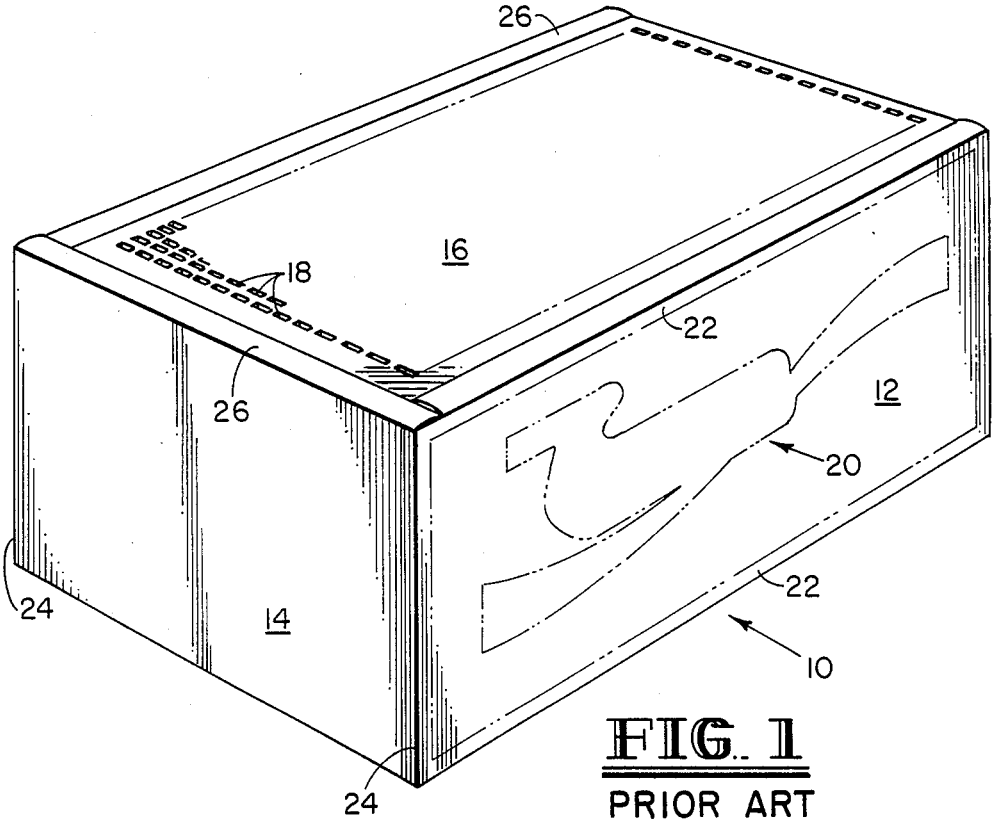
FIG. 1 PRIOR ART
FIG. 1 is a perspective view of a bonnet for a beverage dispensing apparatus of a type which is currently available and is, therefore, labeled as being in the prior art.
Figure 3:
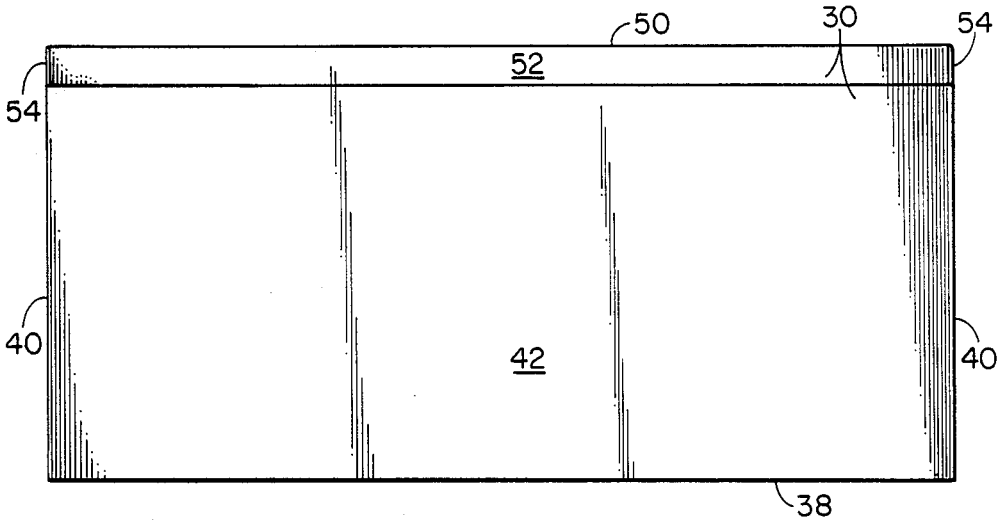
FIG. 3 is a side view of the bonnet of FIG. 2 without the logo shown in shadow lines in FIG. 2.

As can be seen in FIG. 3, when first member 38 and second member 50 are secured to each other in this manner, the end 32 and side walls 30 of bonnet 28 form a substantially flat external surface on each of three walls 30 of bonnet 28. In a presently preferred embodiment, the down-turned edges 52 of second member 50 actually becomes a part of the graphics of the logo 48 applied to each of the side walls 30 and end 32 of bonnet 28 when second member 50 is painted a different color than the color of first member 38. In that manner, each of the side walls 30 and end 32 is provided with a border of uniform dimension along the top edge thereof, eliminating the need for the masking and painting or application of a decal to form such a border. Further, the entirety of first member 38 can be painted one uniform color, greatly simplifying the application of a logo such as the logo 48 to the side walls 30 or end 32 thereof. The down-turned edge 52 of second member 50 is effectively integrated with the trademark and graphics when second member 50 is painted a different color than first member 38.

It will be understood by those skilled in the art who have the benefit of this disclosure that the down-turned edges 52 of second member 50 and the top edges of the sides of first member 38 need not be straight. The individual trademark and graphics of each bonnet may be such that, for instance, the width of the border created by the different color of second member 50 must be greater at one corner 40 than the other, or be formed in a chevron-type or curved configuration.

Further, the cost of the assembly of the bonnet 28 is reduced by the reduction in the number of assembly steps required. The first and second members 38 and 50 need only be formed by appropriate bending and the two members then secured to each other by the rivets 60.

Although the present invention has been described in terms of the above-illustrated presently preferred embodiment, it will be understood by those skilled in the art who have the benefit of this disclosure that changes can be made therein without departing from the spirit and scope of the invention. Such changes are envisioned as falling within the following claims.

What is claimed is:

1. A bonnet for covering a beverage dispensing apparatus comprising:

a first member for forming a bottom portion of three walls of a substantially rectangular enclosure, said first member having one end and two integral sides, each of the end and sides of said first member having a top edge and having an external surface for receiving paint thereon;

a second member for forming the top of said enclosure, said second member having integral down-turned edges on three sides thereof for engaging the top edges of the end and sides of said first member to form a top portion of said three walls of said enclosure, each of said down-turned edges of said second member having an external surface for receiving paint thereon, said second member further having an integral end on a fourth side thereof for forming a fourth wall of said enclosure; and means for securing said down-turned edges of said second member to the top edges of the end and sides of said first member for forming a substantially flat external surface on each of said three walls of said enclosure.

2. The bonnet of claim 1 wherein the integral end of said second member is provided with holes for ventilating a dispensing apparatus covered by said enclosure.

3. The bonnet of claim 1 wherein the top of said second member is provided with holes for ventilating a dispensing apparatus covered by said enclosure.

4. The apparatus of claim 1 wherein the sides and end of said first member are painted a first color and said down-turned edges of said second member are painted a second color.

5. A bonnet for covering a beverage dispensing apparatus comprising:

a first member for forming a bottom portion of a plurality of walls of an enclosure, said first member having a top edge and having an external surface which is painted a first color;

a second member for forming the top of said enclosure, said second member having integral down-turned edges on sides thereof for engaging the top edge of said first member to form top portions of each of said walls, each of said down-turned edges having an external surface which is painted a second color; and means for securing said down-turned edges of said second member to the top edge of said first member for forming a substantially flat external surface on each of said walls of said enclosure.

* * * * *